US006408957B1

(12) United States Patent
Slaughter, Jr. et al.

(10) Patent No.: US 6,408,957 B1
(45) Date of Patent: Jun. 25, 2002

(54) SEALED BEARING ROLLER CONE BIT HAVING ANTI-PLUGGING DEVICE

(75) Inventors: Robert H. Slaughter, Jr., Ponca City; Fakhroldin M. Jadbabaei, Stillwater; Peter T. Cariveau, Ponca City; Vincent W. Shotton, Ponca City; Roger Didericksen, Ponca City, all of OK (US)

(73) Assignee: Smith International, Inc., Houston, TX (US)

( * ) Notice: Subject to any disclaimer, the term of this patent is extended or adjusted under 35 U.S.C. 154(b) by 25 days.

(21) Appl. No.: 09/644,595

(22) Filed: Aug. 23, 2000

(51) Int. Cl.[7] ..... E21B 27/00

(52) U.S. Cl. ..... 175/235; 175/318; 175/337; 175/340; 175/371

(58) Field of Search ..... 175/234, 235, 175/317, 318, 337, 339, 340, 371

(56) References Cited

U.S. PATENT DOCUMENTS

| | | | | |
|---|---|---|---|---|
| 3,084,751 A | 4/1963 | Scarborough | 175/340 |
| 3,685,601 A | 8/1972 | Hollingshead | 175/318 |
| 3,924,695 A | 12/1975 | Kennedy | 175/69 |
| 3,970,158 A | 7/1976 | Black et al. | 175/410 |
| 4,080,091 A | 3/1978 | Hollingshead | 408/60 |
| 4,154,313 A | 5/1979 | Dysart et al. | 175/318 |
| 4,181,187 A | 1/1980 | Lumen | 175/410 |
| 4,184,554 A | 1/1980 | Levefelt | 175/317 |
| 4,245,710 A | 1/1981 | Dolezal et al. | 175/337 |
| 4,248,485 A | 2/1981 | White et al. | 308/8.2 |
| 4,289,211 A | 9/1981 | Lumen | 175/410 |
| 4,372,402 A | 2/1983 | Trevino, Jr. et al. | 175/318 |
| 4,375,242 A | 3/1983 | Galle | 175/228 |
| 4,981,182 A | 1/1991 | Dysart | 175/71 |

FOREIGN PATENT DOCUMENTS

GB 2 019 921 A 10/1979

*Primary Examiner*—Roger Schoeppel
(74) *Attorney, Agent, or Firm*—Rosenthal & Osha L.L.P.

(57) ABSTRACT

A roller cone drill bit is disclosed which includes a bit body having at least one leg depending from the bit body. The leg has a journal formed on it at a lower end. The bit body includes an air channel extending at least from an interior of the bit body to the seal area of the journal. A roller cone is sealingly, rotatably mounted on the journal. The cone has a plurality of cutting elements disposed on it. The bit includes a backflow valve disposed in the bit body, so that an intake end of the air channel is disposed upstream of the backflow valve. In one embodiment, the backflow valve is disposed in a connection end of the bit body, and the air channel includes a flow tube extending from the air passage in the bit body to the backflow valve so that its intake end is upstream of the backflow valve.

8 Claims, 5 Drawing Sheets

SEALED BEARING ROLLER CONE BIT HAVING ANTI-PLUGGING DEVICE

BACKGROUND OF THE INVENTION

1. Field of the Invention

The invention relates generally to the field of roller cone drill bits used to drill boreholes through earth formations. More specifically, the invention relates for devices for excluding dust and debris from the bearings on roller cone bits which can extend the life of such bits.

2. Description of the Related Art

Roller cone bits are used in many applications to drill wellbores through earth formations. A typical roller cone bit includes one or more roller cones rotatably mounted on a bearing journal. The journal forms part of or is coupled to a "leg". The leg forms part of a bit body. The bit body includes a connection at one end, typically threaded, which connects the bit to a rotary power source, such as a downhole motor or a rotary drilling rig. The bit drills by the crushing and gouging action of cutting elements disposed about the surface of the roller cones as the bit is rotated about its axis by the rotary power source.

One application for roller cone drill bits is in the mining industry and the construction industry, where such bits are used to drill "shot holes" in rock for explosives to be inserted therein. Typical drilling rigs used to drill such shot holes include a compressed air source, which pumps air through the threaded connection into the bit. The air is used in some types of roller cone bits to clean and cool the bearings on which the roller cones revolve, and in all types of roller cone bits to cool the cutting elements and the cut rock face, and to lift rock cuttings out of the borehole as it is being drilled. The air which lifts the cuttings is generally discharged through one or more nozzles disposed in the bit body near the roller cones.

Some roller cone bits used in mining and construction shot hole applications include roller cone bearings which are not sealed. Part of the air pumped through the connection to clean the cuttings in these bits is diverted into the bearings through a passage drilled in each leg and bearing journal. Dust and debris which accumulates on the bearing journal during drilling is at least partially cleaned by the air flow. These bits typically do not have a very long bearing life, primarily due to the dust and debris which unavoidably enters and remains in the bearing. Some of the dust and debris which lodges in the bearings enters the bearings during "pipe trips". During a pipe trip, the drilling assembly is removed from the existing wellbore by uncoupling segments of drill pipe to which the bit is attached. During this time, the compressed air is turned off. Cuttings which have not been lifted out of the wellbore may migrate into the bit bearings.

An improvement to the air-cleaned bearing bit which is intended to deal with the problem of cuttings entering the bearings is described in U.S. Pat. No. 3,685,601 issued to Hollingshead. The bit described in this patent includes a backflow valve (BFV) disposed in a nozzle retaining socket. The BFV prevents dust and debris from entering the interior of the bit through the nozzles, particularly during pipe trips. Some of this dust and debris is believed to enter the bearings through the air channels in the legs of the bit. Using a BFV in air-cleaned, open bearing bits did not substantially improve the life of these bits, however.

Other air cleaned bits include seals between the roller cone and bearing journal. These bits show improved life as compared to unsealed bits. One such bit is described, for example, in published British patent no. GB 2019921 filed by Schumacher. The bit disclosed in this patent includes small air passages for keeping the bearing seals clean. Notably, the air passages in sealed bearing, air cleaned bits typically terminate in the seal area of the journal and not in the bearing area of the journal. Sealed bearing bits have an internal lubrication system for the bearings which is separated from the air used to clean and cool the bit.

A limitation to air-cleaned, sealed bearing bits known in the art is that the air passages are typically much smaller than those used in unsealed, air-cleaned bearing bits. The small passages are particularly susceptible to plugging with dust and debris. U.S. Pat. No. 4,981,182 issued to Dysart show a sealed bearing, air-cleaned bit which includes a porous gas restrictor at the opening of the cone mouth used to prevent dust and debris from entering the seal area during times when no air is supplied to the bit. This bit includes an air screen disposed at the top of the small air passages used to conduct air to the bearings. The air passages are subject to plugging when the air is turned off (such as during pipe trips) and dust and debris enter the interior of the bit.

U.S. Pat. No. 4,184,554 issued to Leverfelt describes an air bearing bit including a provision for excluding debris from the air channels in the bit which supply air to the bearings. Much of the debris exclusion system in the bit described in this patent is directed to separating water from the air stream, rather than excluding debris from the bearings. Further, the bearings on the bit shown in the Leverfelt '554 patent are unsealed, and are subject to early failure due to dust and debris entering the bearings from the open cone mouth.

Yet another type of air cleaned bit is shown in U.S. patent applications Ser. Nos. 06/293,053, now abandoned, and 06/293,054, now abandoned, filed on Aug. 17, 1981 by Price et al. The bit shown in these applications includes an air pressure regulator to control the flow of air to air-cleaned bearings (which are unsealed) in a roller cone bit.

Another type of sealed-bearing, air-cleaned bit is sold under the trade name "CHARGER" by Smith International, Inc., Houston, TX, also the assignee of the present invention. A cross-section of one of these prior art bits is shown in FIG. 1. A bit body 10 is formed from one or more "legs" 15A, each of which includes a bearing journal 15 formed thereon. Each journal includes a roller cone (not shown) having a plurality of cutting elements thereon, rotatably mounted to the journal 15. The bit body 10 includes a threaded coupling 11 at one end for connection to drill pipe (not shown) in a conventional manner. The drill pipe (not shown) conducts compressed air to the bit. Each leg 15A includes an air channel 17 drilled from the seal area of the journal 15 to the interior 18 of the bit body 10. Some of the compressed air which enters the bit from the threaded connection 11 is diverted through the air channels 17 to keep the seal area free of dust and debris. The bit shown in FIG. 1 includes a backflow valve 13 disposed inside the area of the threaded connection 11. The backflow valve 13 only allows air (and dust/debris) movement in one direction, and therefore reduces the amount of dust and debris which enters the interior 18 of the bit. However, some dust and debris still can enter the bit during pipe trips. Such dust and debris has been known to plug one or more of the air channels 17. When one of the air channels 17 becomes plugged, the bearing seal associated with the plugged air channel cannot receive air. In this case, the seal is subject to early failure. Seal failure leads to rapid subsequent bearing failure in a sealed bearing bit.

It is desirable to provide a sealed bearing, air-cleaned bit which has reduced susceptibility to plugging of air passages used to keep the seals clean.

SUMMARY OF THE INVENTION

The invention is a roller cone drill bit which includes a bit body having at least one leg depending from the bit body. The at least one leg has a journal formed on its at a lower end. The bit body includes an air channel extending at least from an interior of the bit body out to the seal area of the journal. A roller cone is sealingly, rotatably mounted on the journal. The cone has a plurality of cutting elements disposed on it, The bit includes a backflow valve disposed in the bit body, so that an intake end of the air channel is disposed upstream of the backflow valve.

In one embodiment, the backflow valve is disposed in a connection end of the bit body, and the air channel includes a flow tube extending from the air passage in the bit body to the backflow valve so that its intake end is upstream of the backflow valve.

In another embodiment, the bit body includes a plurality of legs, each having a journal and roller cone rotatably, sealingly mounted on the journal. Each leg has an air passage extending from the seal area of the journal to the interior of the bit body so that its intake end extends upstream of a backflow valve disposed in the bit body. In one embodiment, each air passage includes a flow tube extending upstream of a backflow valve which is positioned in a connection end of the bit. One embodiment of the backflow valve is a spring loaded flapper valve.

DETAILED DESCRIPTION OF THE INVENTION

Figure 2:
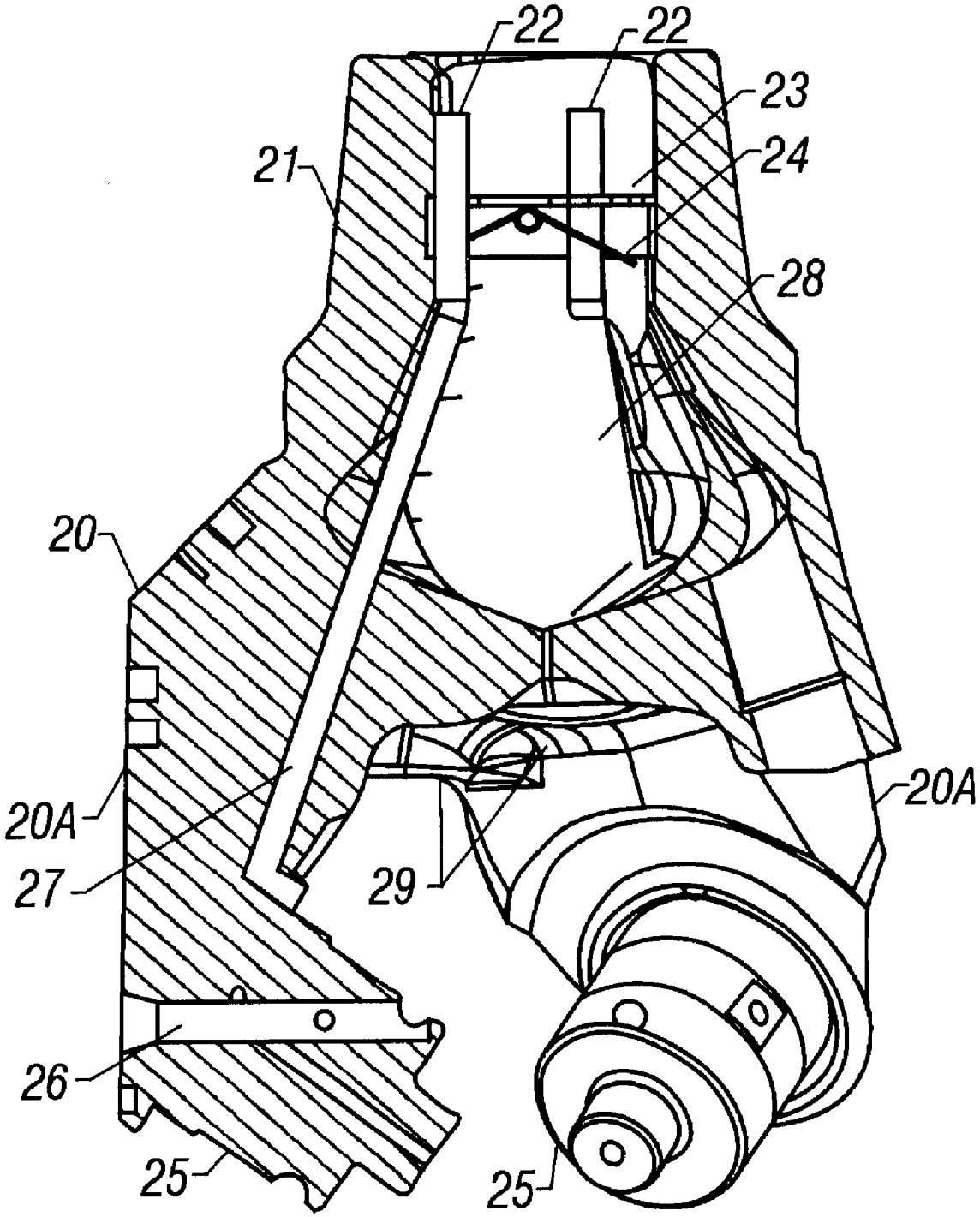
FIG. 2 shows one example of an air-cleaned bit according to the invention.

One example of an air-cleaned bit according to the invention is shown in partial cross sectional view in FIG. 2. FIG. 2 shows only a bit body 20 and elements therein according to this embodiment for clarity of the illustration, and does not show roller cones as would typically be rotatably coupled to the bit body in any manner known in the art. It should be understood that for purposes of this invention, the type of, construction of and manner of attaching the roller cones is a matter of discretion for the bit designer and is not intended to limit the invention. However, the roller cones (not shown) include seals to exclude material from entering the bearing area of the bit body 20.

Figure 1:
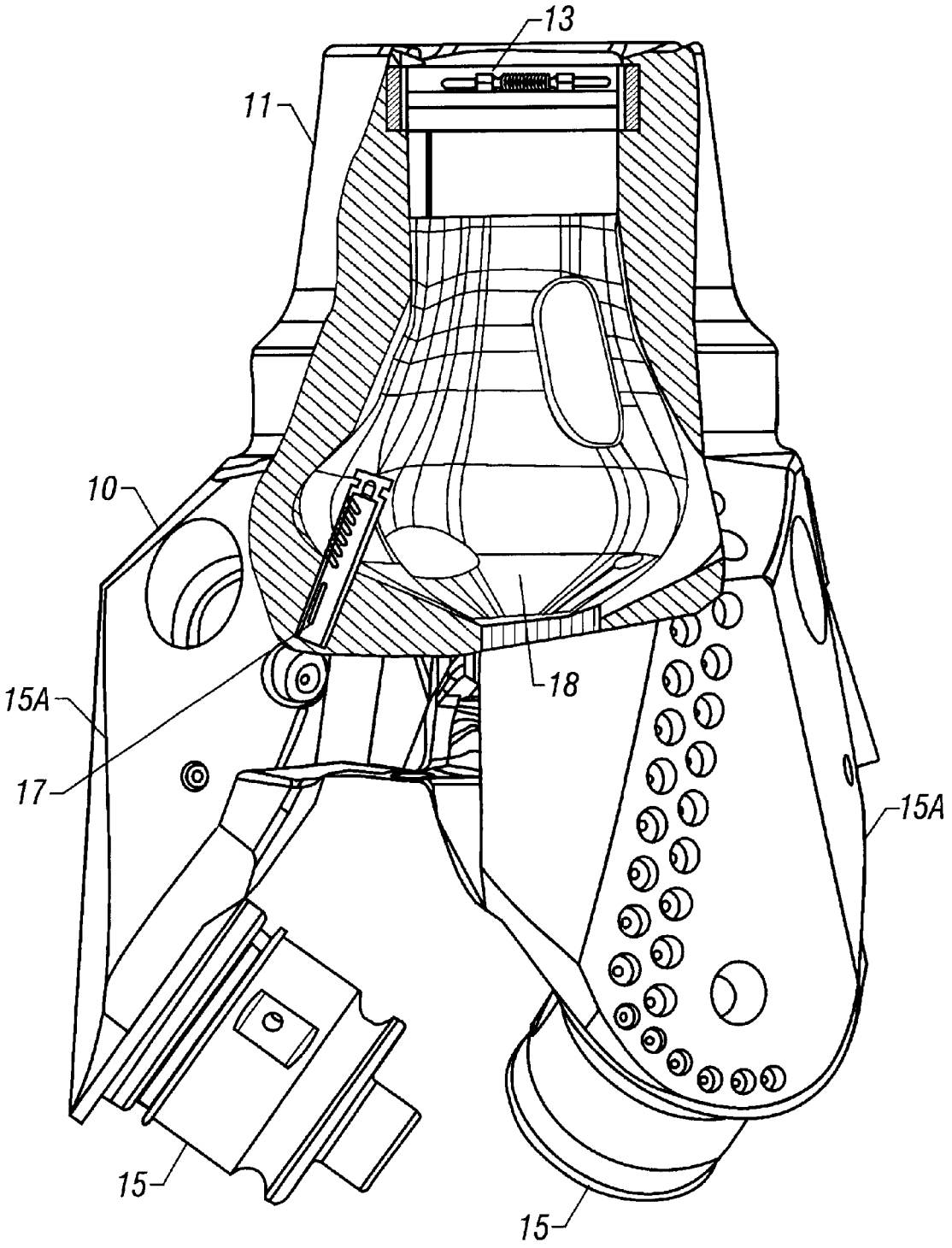
FIG. 1 (Prior Art)
FIG. 1 shows a prior art sealed bearing air-cleaned bit.

The bit body 20 is typically formed from one or more legs 20A. One end of the bit body 20 has formed thereon a threaded coupling 21 of any type known in the art to couple the bit to a rotary power source (not shown). Each one of the legs 20A has a bearing journal 25 formed thereon at one end for rotatably mounting thereon of one of the roller cones (not shown). In the example shown in FIG. 2, the journal 25 has a passage 26 drilled therethrough for insertion of a ball-type cone retaining mechanism. It should understood that other types of cone retention devices known in the art may be used with a bit according to the invention, and that the type of cone retention, just as the type of roller cone (not shown), is not meant to limit the invention. Each leg 20A also includes an air channel 27 which is drilled from the seal area of the journal 25 to an exit point in the interior 28 of the bit body 20. The air channel 27 itself in this embodiment is similar to the air channel of the prior art bit shown in FIG. 1. The air channel 27 is disposed such that the bearing journal 25 is substantially hydraulically isolated from the air channel 27. This configuration is intended to separate air flowing through the channel 27 from lubricant supplied to the journal 25 from a conventional, sealed bearing lubrication system (not shown) of any type known in the art for used with sealed bearing roller cones.

The end of the air channel 27 which enters the interior 28 of the body 20 has inserted therein an air flow tube 22. The other end of the flow tube 22 is disposed near the threaded connection 21 inside the bit body 20 and is adapted to accept some of the compressed air flow pumped through the bit. A backflow valve 23 which can be similar in overall design to the backflow valve shown in the prior art bit of FIG. 1 (13 in FIG. 1), is disposed inside the threaded connection 21 just below the uppermost ends of the flow tubes 22. The backflow valve 23 can be a flapper door type well known in the art, held normally closed by a spring 24 or similar biasing device. The relationship between air flow tubes 22 and the backflow valve 23 will be further explained.

The interior 28 of the bit body can include air discharge ports 29 to enable some of the compressed air to flow outward around the roller cones (not shown) to clean the dust and debris from the cones and to lift them out of the borehole. The discharge ports 29 can be drilled passages, may include nozzles (not shown) or be any similar type of discharge port known in the art.

Figure 4:
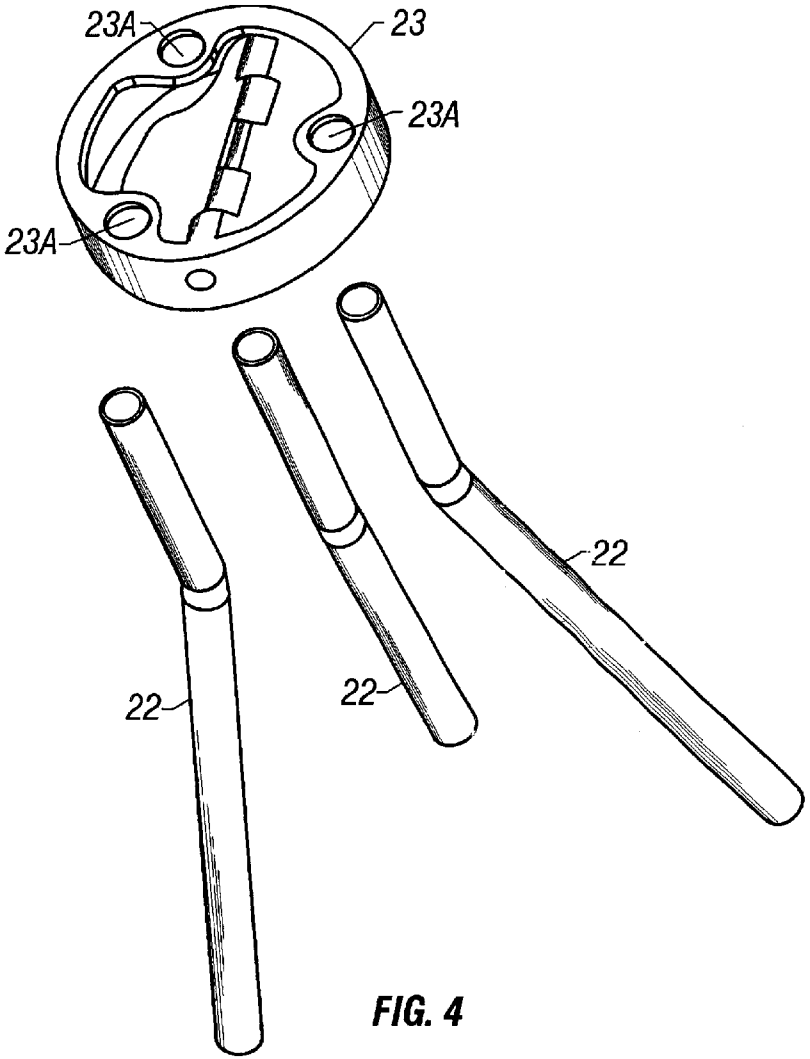
FIG. 4 shows the backflow valve and flow tubes of FIG. 3 in exploded view.
Figure 3:
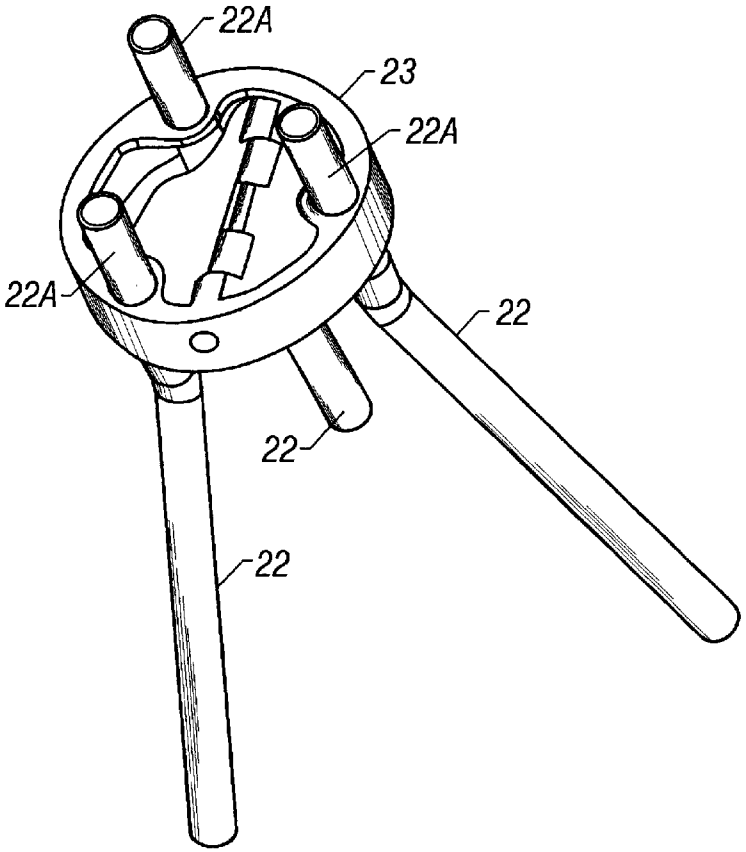
FIG. 3 shows an example of air flow tubes and a backflow valve according to the example embodiment shown in FIG. 2.
Figure 6:
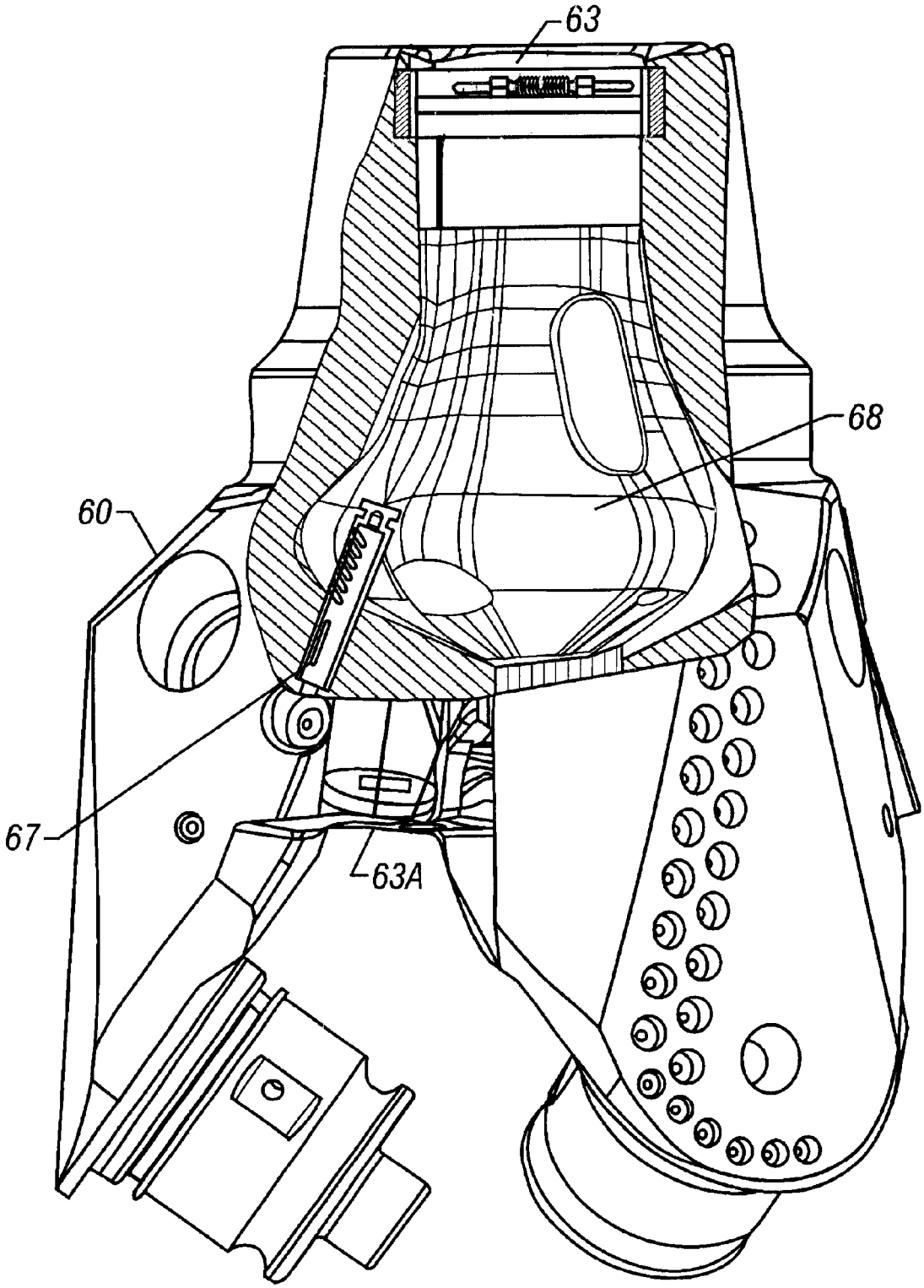
FIG. 6 shows an alternative embodiment of the invention.

The flow tubes 22 and backflow valve 23 are shown in more detail in FIGS. 3 and 4. The tubes 22 and valve 23 are shown assembled in FIG. 3. An intake end 22A of each tube 22 is shown in a position above the valve 23. By positioning the intake 22A above the valve 23, dust and debris which may enter the interior (28 in FIG. 2) of the bit body is substantially excluded from the flow tubes 22. This reduces the possibility of plugging any of the air channels (27 in FIG. 2), thereby reducing the possibility of an early seal failure to any of the bearings on the bit. The tubes 22 and valve 23 are shown in exploded view in FIG. 4, to show more clearly passages 23A in the valve body for insertion of the flow tubes therethrough. Although the intakes 22A of the tubes 22 are shown as being disposed proximate to the threaded connection (21 in FIG. 2) for purposes of the invention, it is only necessary to position the intake of the air channel (27 in FIG. 2) on the "upstream" side of any backflow valve to perform according to the invention. "Upstream" means towards the source of compressed air coupled to the bit. In the embodiment of FIGS. 2, 3, and 4, this is performed by disposing the intake ends 22A of the flow tubes 23 on the upstream side of the backflow valve. Other embodiments may be devised which have the same effect but do not use flow tubes. For example, an individual backflow valve may be disposed in each one of the air discharge ports (29 in FIG. 2) instead of the single valve (23 in FIGS. 2 through 4) disposed proximate to the threaded connection, to prevent dust and debris from entering the interior of the bit body 20. This configuration would enable making the bit without using the flow tubes as shown in FIG. 2. An example of this embodiment is shown in FIG. 6. The bit body 60, which can be similar to the bit body shown in FIG. 2, includes an air channel 67 for each leg drilled substantially as explained for the previous embodiment, and includes a backflow valve 63A in each nozzle area of the bit body 60. The backflow valve of the previous embodiment, shown at 63 in FIG. 6, may be omitted entirely from the present embodiment. The presence of a backflow valve 63A in each nozzle port effectively prevents entry of any dust and debris into the interior of the body 68. As a result, the intake end of each air channel 67 is upstream of the backflow valves 63A and consequently does not require flow tubes (22 in FIG. 2) to place the intake end upstream.

Furthermore, the type of backflow valve is not intended to limit the invention. Types of backflow valves other than the one shown in FIGS. 2, 3, 4 and 6 may also be used with this invention.

An advantage offered by the embodiment of the bit shown in FIGS. 2, 3 and 4 is that is enables the use of only one backflow valve, and further enables easily and economically modifying sealed bearing, air-cleaned drill bits made according to the prior art to perform according to the invention.

Figure 5:
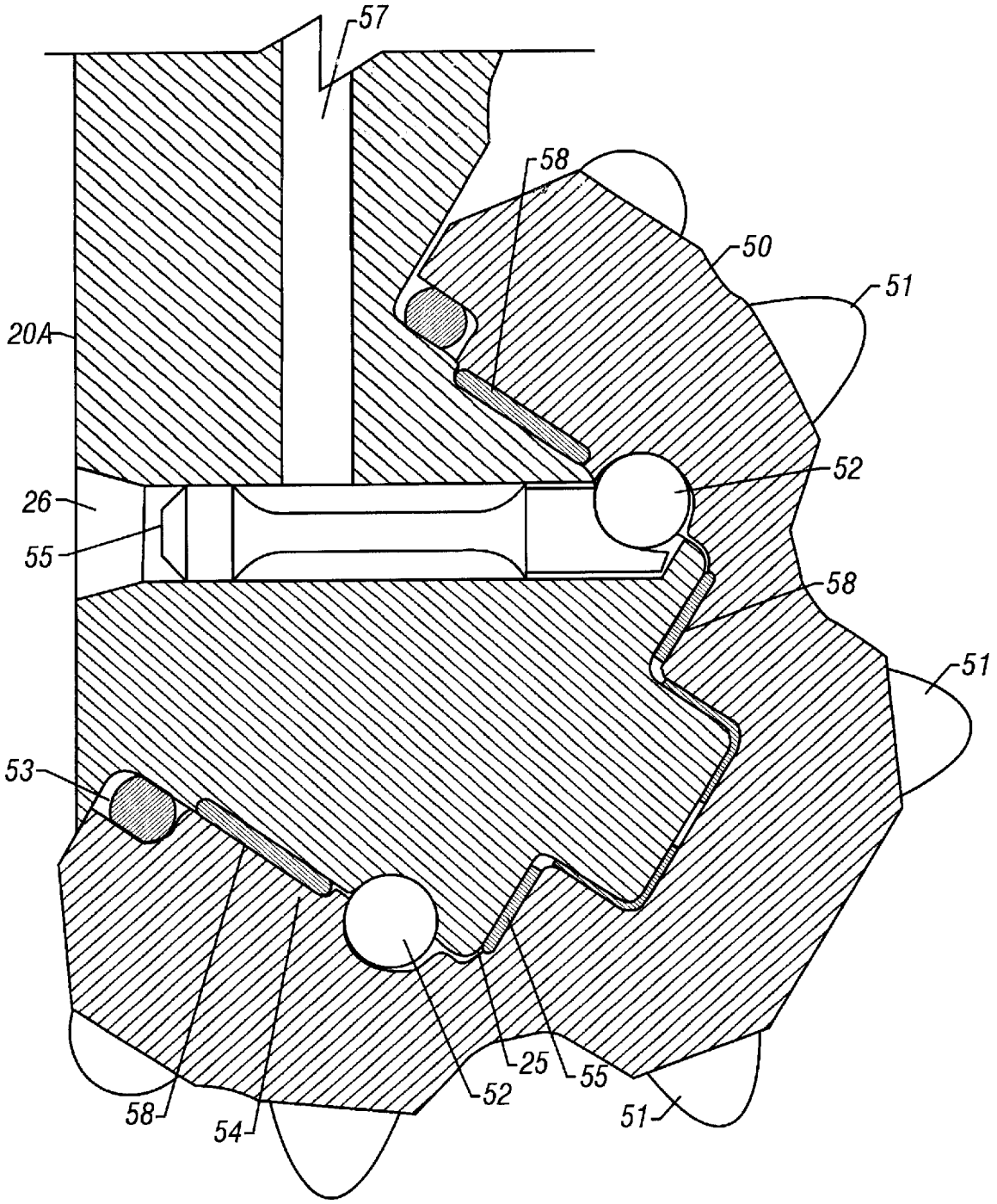
FIG. 5 shows one embodiment of a bit leg and journal having a roller cone rotatably mounted thereon.

An example of a roller cone 50 rotatably mounted on one of the bearing journals 25 forming part of a leg 20A is shown in FIG. 5. The cone 50 in this example includes a plurality of insert type cutting elements 51 disposed at selected positions on the cone 50. The cone 50 in this example is held in place on the journal 25 by retaining balls 52 inserted through passage 26 and held in place by a ball hole lock pin 55, as is conventional for ball-type cone retainers. The cone 50 rotates about the journal 54 on bearings 58 which can be any type suited for air-cleaned bits including journal, ball and/or roller bearings. The bearings 58 are sealed from the exterior environment by a seal 53 which can be an elastomeric ring or any other type of seal suitable for sealing roller cone bearings. The air channel (27 in FIG. 2) is not shown in FIG. 5 for clarity, but a type of passage present on many sealed bearing bits is shown at 57 in FIG. 5. This passage 57 is a lubricant passage which hydraulically couples the bearing area of the journal 54 with a lubricant reservoir (not shown) in a manner conventional for sealed bearing roller cone bits.

The invention has been shown in terms of certain embodiments. Those skilled in the art will devise other embodiments of the invention which do not depart from the spirit of the invention as disclosed herein. Accordingly, the invention shall be limited in scope only by the attached claims.

What is claimed is:

1. A roller cone drill bit, comprising:

a bit body having at least one leg depending therefrom, the at least one leg having a journal formed thereon at a lower end, the bit body including an air channel extending at least from an interior of the bit body to a seal area on the journal;

a roller cone sealingly, rotatably mounted on the journal, the cone having a plurality of cutting elements disposed thereon; and at least one backflow valve disposed in the bit body so that an intake end of the air channel is disposed upstream of the backflow valve.

2. The bit as defined in claim 1 wherein the air channel comprises a passage drilled from the seal area of the journal to an interior of the bit body, and a flow tube disposed in an intake end of the passage, the flow tube having an intake end disposed upstream of the backflow valve, the backflow valve disposed inside the bit body at a connection end thereof.

3. The bit as defined in claim 1 wherein the backflow valve comprises a spring-biased flapper valve.

4. The bit as defined in claim 1 further comprising a plurality of legs depending from the bit body and having a journal formed thereon, each of the journals having a roller cone rotatably, sealingly mounted thereon, each leg having an air channel extending at least from the interior of the bit body to a seal area on each of the journals, each of the air channels having an intake end thereof disposed upstream of the backflow valve.

5. The bit as defined in claim 4 wherein each air channel comprises a passage drilled from the journal to an interior of the bit body, and a flow tube disposed in an intake end of the passage, each flow tube having an intake end disposed upstream of the backflow valve.

6. The bit as defined in claim 1 further comprising:

a plurality of legs depending from the bit body and having a journal formed thereon, each of the journals having a roller cone rotatably, sealingly mounted thereon, each leg having an air channel extending at least from the interior of the bit body to a seal area on each of the journals; and a plurality of backflow valves disposed downstream of the interior of the bit body so that each of the air channels has an intake end thereof disposed upstream of the backflow valves.

7. The bit as defined in claim 6 wherein the backflow valves are each disposed in a corresponding nozzle area of the bit body.

8. The bit as defined in claim 1 wherein the air channel is substantially hydraulically isolated from a lubricated bearing portion of the journal.

* * * * *